US006629796B2

(12) United States Patent
Kawakami et al.

(10) Patent No.: US 6,629,796 B2
(45) Date of Patent: Oct. 7, 2003

(54) PRINTER

(75) Inventors: Hideki Kawakami, Nagano (JP); Satoshi Iwaya, Nagano (JP); Naoki Kobayashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/829,442

(22) Filed: Apr. 10, 2001

(65) Prior Publication Data

US 2001/0039893 A1 Nov. 15, 2001

(30) Foreign Application Priority Data

Apr. 12, 2000 (JP) ..... P.2000-111215
Mar. 12, 2001 (JP) ..... P.2001-069334

(51) Int. Cl.[7] ..... B41J 11/44
(52) U.S. Cl. ..... 400/582; 400/74
(58) Field of Search ..... 400/582, 74; 358/1.16

(56) References Cited

U.S. PATENT DOCUMENTS 5,594,653 A * 1/1997 Akiyama et al. ..... 358/1.15
5,800,081 A * 9/1998 Teradaira et al. ..... 400/703
5,820,068 A * 10/1998 Hosomi et al. ..... 242/563
5,969,754 A * 10/1999 Zeman ..... 348/136
6,000,865 A * 12/1999 Takamizawa et al. ..... 400/279
6,082,910 A * 7/2000 Teradaira et al. ..... 400/61
6,122,073 A * 9/2000 Miyasaka et al. ..... 358/1.15
6,345,782 B1 * 2/2002 Nakayama et al. ..... 242/564.4
6,362,896 B1 * 3/2002 Miyasaka et al. ..... 358/1.16

FOREIGN PATENT DOCUMENTS

EP 0 615 850 9/1994
JP 56-62476 5/1981
JP 1-181629 7/1989
JP 07215533 A1 * 8/1995 ..... B65H/7/06

OTHER PUBLICATIONS

Patent Abstract of Japan, vol. 013, No. 033 (M–789), Jan. 25, 1989 and JP 63 242676 A (Tokyo Electric Co Ltd).

Patent Abstract of Japan, vol. 014, No. 424 (M–1024), Sep. 12, 1990 and JP 02 167760 A (Ricoh C Ltd).

Patent Abstract of Japan, vol. 011, No. 094 (M–574), Mar. 25, 1987 and JP 61 246082 A (NEC Home Electronics Ltd).

Patent Abstract of Japan, vol. 1999, No. 10, Aug. 31, 1999 and JP 11 125983 A (Canon Inc).

Patent Abstract of Japan, vol. 1997, No. 09, Sep. 30, 1997 and JP 09 136730 A (Fujitsu Ltd).

Patent Abstract of Japan, vol. 017, No. 053 (M–1361), Feb. 3, 1993 and JP 04 263977 A (NEC Off Syst Ltd).

* cited by examiner

*Primary Examiner*—Charles H. Nolan, Jr.
(74) *Attorney, Agent, or Firm*—Nixon & Vanderhye P.C.

(57) ABSTRACT

A printer including a cover state detector and a paper detector. The cover state detector detects whether a cover is opened with respect to a casing of a printer, whereas the paper detector detects whether paper is present within the casing. When the cover is opened, a detection result of the cover state detector is transmitted to a print controller prior to the time when a detection result of the paper detector is transmitted to the print controller.

22 Claims, 11 Drawing Sheets

PRINTER

BACKGROUND OF THE INVENTION

The present invention relates to a printer for printing characters on rolled paper stored in a casing, and more particularly to a printer having functions of detecting the presence or absence of rolled paper in a casing and of detecting an open or closed state of a door cover for making the rolled paper storable.

There is a related art printer generally called a rolled-paper printer that has a housing space in a casing and is used for printing characters on paper that is led out of a paper roll. As it is unnecessary to supplement paper to such a rolled-paper printer over a long period of time, the rolled-paper printer is suitable for use as a printer together with a cash register or the like. The rolled-paper printer is provided with a door cover for opening or closing a part of the housing space so that an operator can put rolled paper in the housing space by opening the door cover.

In the related art rolled-paper printer is equipped with several condition sensors like common printers in order to inform an operator of internal conditions thereof. These sensors include a cover state sensor for detecting the state of the door cover, that is, for detecting whether the cover is opened or closed, and a paper detection sensor for detecting the presence or absence of the rolled paper in the housing space.

The cover state sensor is formed with, for example, an optical sensor and a micro-switch, wherein the optical sensor is disposed near a free end of a door cover. The cover state sensor is used for detecting the change in quantity of received light, and for detecting the on-off states of a switch resulting from the movement of a specific portion (e.g., an extended area of the frame) of the door cover at the time the cover is opened or closed. The paper detection sensor is formed with, for example, an optical sensor and a micro-switch, wherein the optical sensor is disposed in a housing space. The paper detection sensor is used for detecting the change in quantity of received light, and for detecting the on-off states of the switch resulting from the presence or absence of the rolled paper.

On the other hand, in order to facilitate installing a rolled paper in the housing space, another rolled-paper printer is so arranged that a paper drawn out from the rolled paper is released from a paper path when the door cover is opened. For example, a print head and a platen are moved away from one another, and a pair of feed rollers are moved away from each other when the door cover is opened. With this arrangement of the printer, the paper may be moved away from a paper detection sensor disposed in the paper path as the door cover opens.

Consequently, when the paper detection sensor detects the movement of the paper as the door cover opens before the cover state sensor detects the movement of the door cover, an error in detection may occur and the problem is that the operator receives false information. Namely, the printer may inform to the operator or user "paper end" instead of "cover open", while the remaining amount of the paper is enough for printing.

It may be configured that the printing is halted or forbidden without identifying the kind of error (paper end or cover open) because troubles would occur if the printing is continued under any of the error conditions. However, in a case where a printer is loaded in a POS (point-of-sales) cash register or the like, it is necessary to notify which error is occurred to direct a next operation to an operator.

SUMMARY OF THE INVENTION

It is therefore an object of the present invention to provide a printer so arranged as to ensure that a sensor for detecting the state of a door cover outputs its detected result before a sensor for detecting the presence or absence of rolled paper outputs its detected result.

In order to achieve the above object, according to the present invention, there is provided a printer comprising:

holder, which accommodates paper therein;

a cover, which is movable between a first position for covering the paper accommodated in the holder and a second position for opening the holder such that an operator is able to access the accommodated paper;

a print mechanism, which transports the paper and prints information thereon;

a print controller, which controls the print mechanism to perform printing process;

a cover state detector, which outputs a first detection signal when the cover is moved from the first position to the second position;

a paper detector, which outputs a second detection signal when the paper has run out; and a delay generator, which delays the transmission of the second detection signal to the print controller relative to the first detection signal.

With the arrangement above, it is ensured that when the cover is placed in the second position (opened), the first detection signal outputted from the cover state detector is obtained before the second detection signal outputted from the paper detector. Thus, an error in detection is presented from occurring when the cover is opened.

According to the invention, there is also provided a printer comprising:

a holder, which accommodates paper therein;

a cover, which is movable between a first position for covering the paper accommodated in the holder and a second position for opening the holder such that an operator is able to access the accommodated paper;

a print mechanism, which transports the paper and prints information thereon;

a print controller, which controls the print mechanism to perform printing process;

a cover state detector, which outputs a first detection signal when the cover is moved from the first position to the second position, the cover state detector including a first lever, which moves in cooperation with the movement of the cover, and a first detector that detects the movement of the first lever;

a paper detector, which outputs a second detection signal when the paper has run out, the paper detector including a second lever, which moves in cooperation with the movement of the cover and moves when the paper accommodated in the holder runs out, and a second detector that detects the movement of the second lever; and a support member, which supports the cover state detector and the paper detector such that the movement of the first lever is detected by the first detector prior to when the movement of the second lever is detected by the second detector.

Here, it is preferable that the printer further comprises, a frame that supports the holder, a print head disposed on one of the cover or the frame, and a platen disposed on the other one of the cover or the frame. The platen is opposed to the print head so as to perform printing on the paper guided therebetween, while the cover is placed in the first position.

Preferably, the first and second levers are arranged to pivot around an axis that is perpendicular to a direction in which the paper is transported.

Preferably, the printer further comprises: a guide plate, which guides the paper toward the print mechanism; and an urging member that urges each of the first and second levers toward the guide plate.

Here, it is preferable that the guide plate is formed with a cutout portion into which the second lever enters, when the paper accommodated in the holder runs out. Also, the second detector detects the movement of the second lever when the second lever enters the cutout portion.

Preferably, the first and second levers are pivotably supported by the support member. Also, the first detector includes a first button switch onto which the first lever abuts Further, the second detector includes a second button switch onto which the second lever abuts.

Preferably, the printer further comprises a notifier, which notifies that the cover is opened, when the movement of the first lever is detected by the first detector, and which notifies that the paper accommodated in the holder has run out, when the movement of the second lever is detected by the second detector.

According to the invention, there is also provided a printer comprising:

a holder, which accommodates paper therein;

a cover, which is movable between a first position for covering the paper accommodated in the holder and a second position for opening the holder such that an operator is able to access the accommodated paper;

a print mechanism, which transports the paper and prints information thereon;

a print controller, which controls the print mechanism to perform printing;

a cover state detector, which outputs a first detection signal when the cover is moved from the first position to the second position;

a paper detector, which outputs a second detection signal when the paper has run out; and a delay circuit that delays the transmission of the second detection signal to the print controller relative to the first detection signal.

Here, it is preferable that the printer further comprises: a frame that supports the holder; a print head disposed on one of the cover or the frame, and; a platen disposed on the other one of the cover or the frame, wherein the platen is opposed to the print head so as to perform printing on the paper guided therebetween, while the cover is placed in the first position.

According to the invention, there is also provided a printer comprising:

a holder, which accommodates paper therein;

a cover, which is movable between a first position for covering the paper accommodated in the holder and a second position for opening the holder such that an operator is able to access the accommodated paper;

a print mechanism, which transports the paper and prints information thereon;

a cover state detector, which outputs a first detection signal when the cover is moved from the first position to the second position;

a paper detector, which outputs a second detection signal when the paper has run out; and a controller for controlling the print mechanism to perform printing process, wherein the controller executes a first interruption process prior to the printing process, when receiving the first detection signal within a predetermined time period, and executes a second interruption process that is different from the first interruption process, when receiving no first detection signal within the predetermined time period.

Here, it is preferable that the printer further comprises a timer, which counts the predetermined time period. The controller executes the first interruption process, when receiving the first detection signal prior to the second detection signal. The timer starts to count the predetermined time period, when receiving the second detection signal prior to the first detection signal.

Preferably, the controller halts or forbids printing process, during each of the first and second interruption processes.

Further, preferably, the printer comprises a notifier, which notifies that the cover is opened, when the first interruption process is executed.

Moreover, preferably, the printer further comprises a notifier, which notifies that the paper accommodated in the holder has run out, when the second interruption process is executed.

According to the present invention, there is also provided an error process method, used for the above printer provided with a holder, which accommodates paper therein; a cover, which is movable between a first position for covering the paper accommodated in the holder and a second position for opening the holder such that an operator is able to access the accommodated paper; a print mechanism, which transports the paper and prints information thereon; a cover state detector, which outputs a first detection signal when the cover is moved from the first position to the second position and; a paper detector, which outputs a second detection signal when the paper has run out; the error process method comprising the steps of:

counting a predetermined time period, when receiving the second detection signal;

executing a first interruption process prior to a printing process, when receiving the first detection signal the predetermined time period; and executing a second interruption process, which is different from the first interruption process, when receiving no first detection signal within the predetermined time period.

Preferably, the first interruption process is executed when receiving the first detection signal prior to the second detection signal. And the counting step is established when receiving the second detection signal prior to the first detection signal.

Also, preferably, each of the first and second interruption processes includes a step of halting or forbidding the printing.

Further, preferably, the first interruption process includes at least one of the steps of: notifying a cover open error to a host connected to the printer; and notifying a cover open error to the operator through a notifier provided with the printer.

Still further, preferably, the second interruption process includes at least one of the steps of., notifying a paper end error to a host connected to the printer; and notifying a paper end error to the operator through a notifier provided with the printer.

Moreover, preferably, the predetermined time period is so determined as to be smaller than a value L/v, where L is a distance between a printing position of the print mechanism and a detecting position of the paper detector, and v is a transporting velocity of the paper.

BRIEF DESCRIPTION OF THE DRAWINGS

The above and other objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Figure 1:
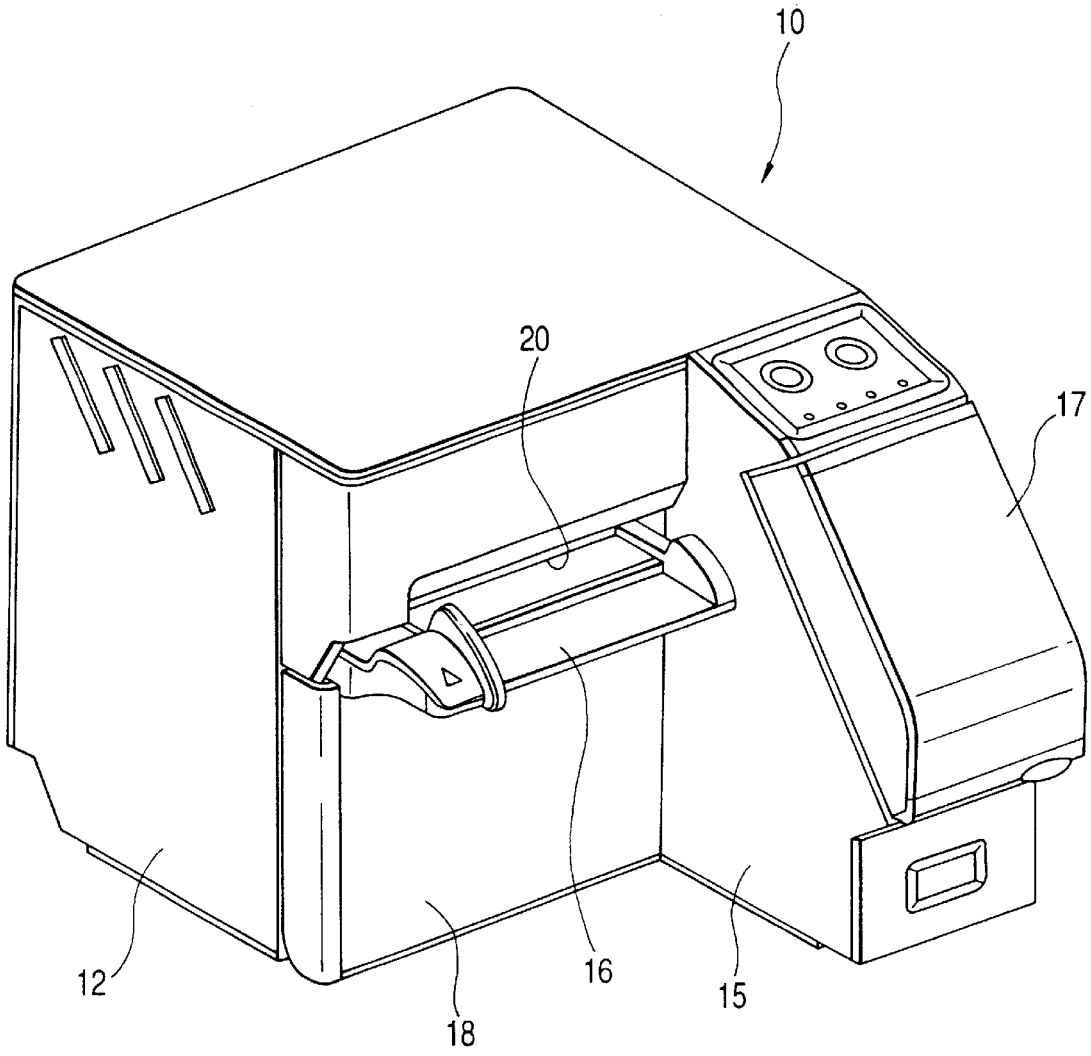
FIG. 1 is an external perspective view of a printer according to a first embodiment of the invention, and shows a state wherein a door cover is closed.

An embodiment of the present invention will now be described with reference to the accompanying drawings. A printer 10 shown in FIG. 1 is an ink-jet type printer, which is a first embodiment of the invention. A frame member (not shown) is loaded with functional printing parts that are packaged in, for example, a plastic case member forming a casing 12.

Figure 2:
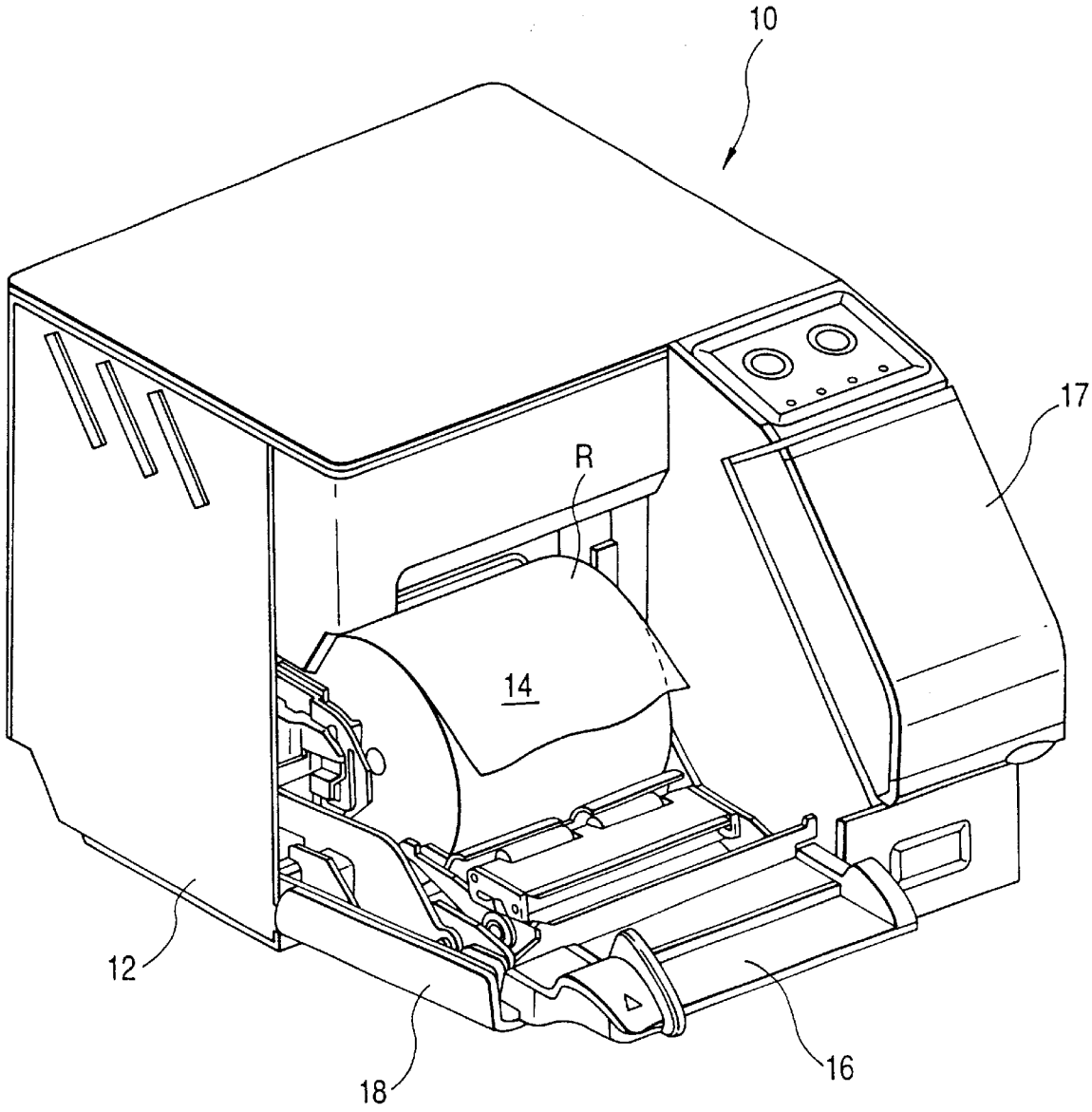
FIG. 2 is an external perspective view of the printer of FIG. 1, and shows a state wherein the door cover is opened.

As shown in FIG. 2, a space 14 for housing rolled paper is formed in the casing 12. In the housing space 14, a holder 14*b* (see FIG. 4) is disposed to secure the rolled paper at a predetermined position. The end r of rolled paper R is sent out from a discharging section 16, placed in the front, and is given to an operator. A door cover 18 is formed beneath the discharging section 16 as will be described later, and the housing space 14 is opened by opening the door cover 18. By opening the door cover 18, the operator can access the Interior of the housing space 14, and can insert the rolled paper R in this state. The lower end of the door cover 18 is pivotally supported by the casing 12 and the upper end thereof is adapted to be opened to the operator. While the door cover 18 is closed, the end of the rolled paper R put into the housing space 14 is pulled out from a gap 20 that is located between the upper end of the door cover 18 and the casing 12, and that is provided in the discharging section 16. The printer 10 is provided with an ink cartridge container 15; and an ink cartridge is mounted therein by opening a door cover 17.

Figure 3:
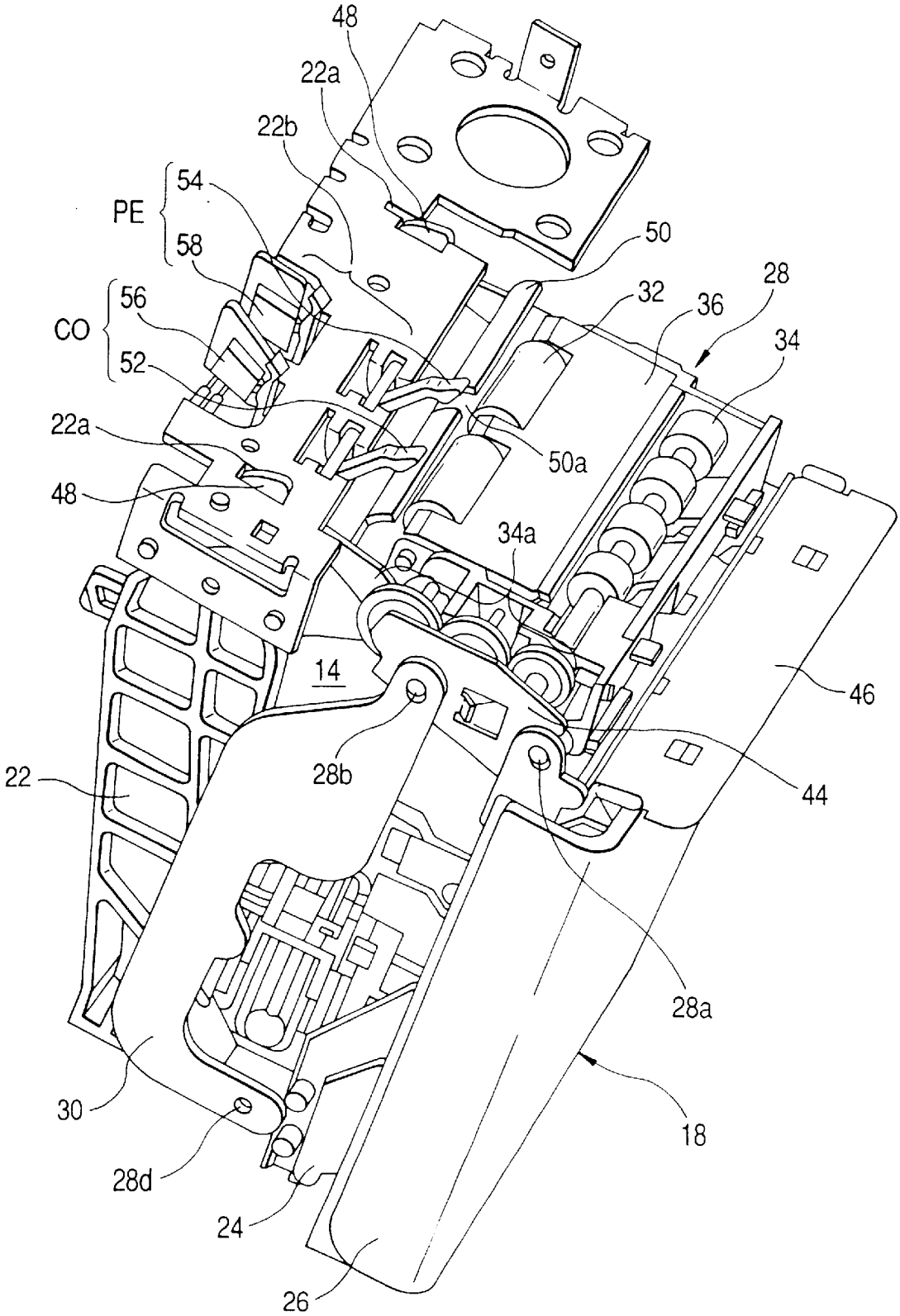
FIG. 3 is a perspective view of an internal structure around the housing space while the door cover is closed.
Figure 4:
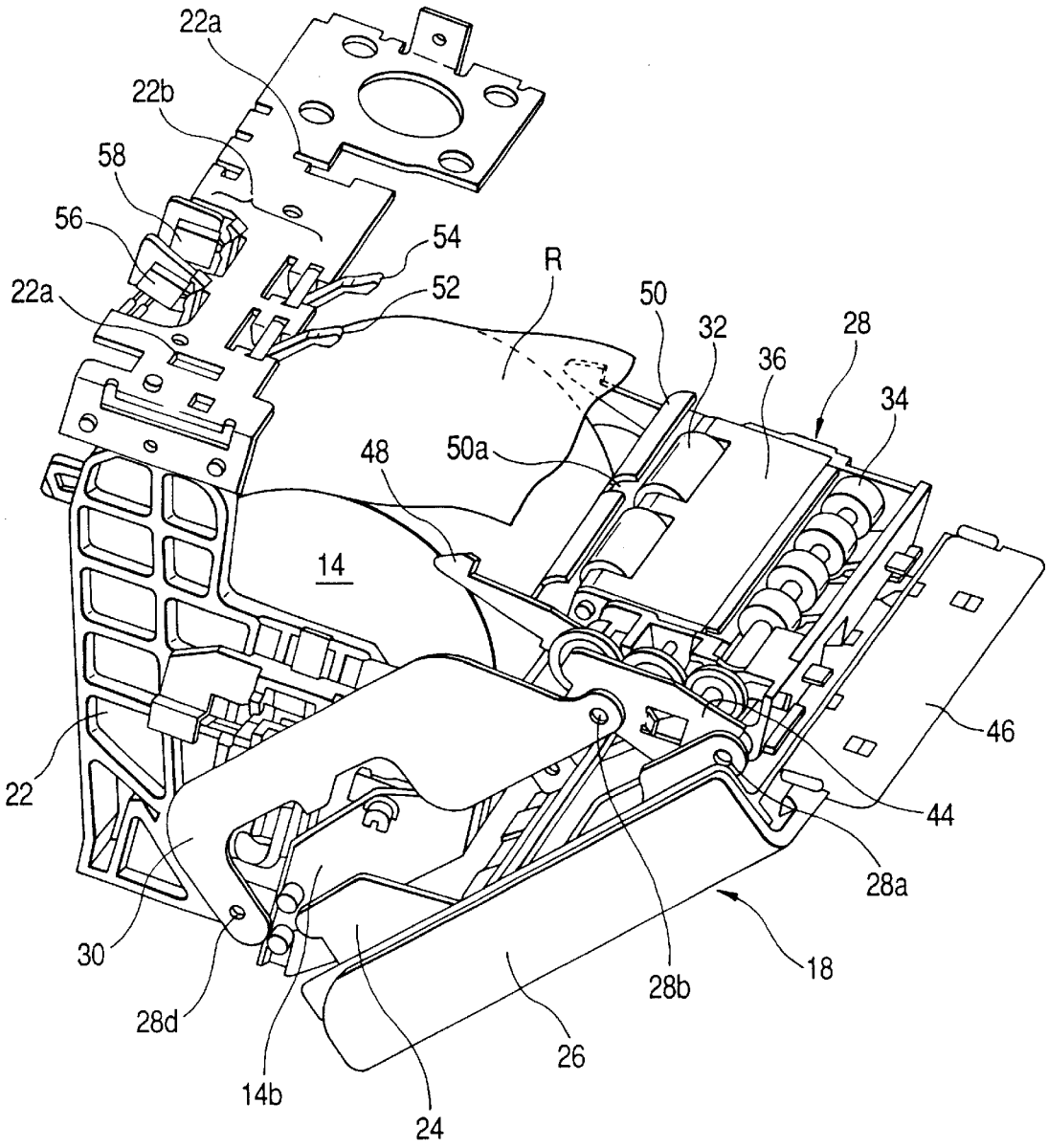
FIG. 4 is a perspective view of the internal structure around the housing space while the door cover is opened.
Figure 5:
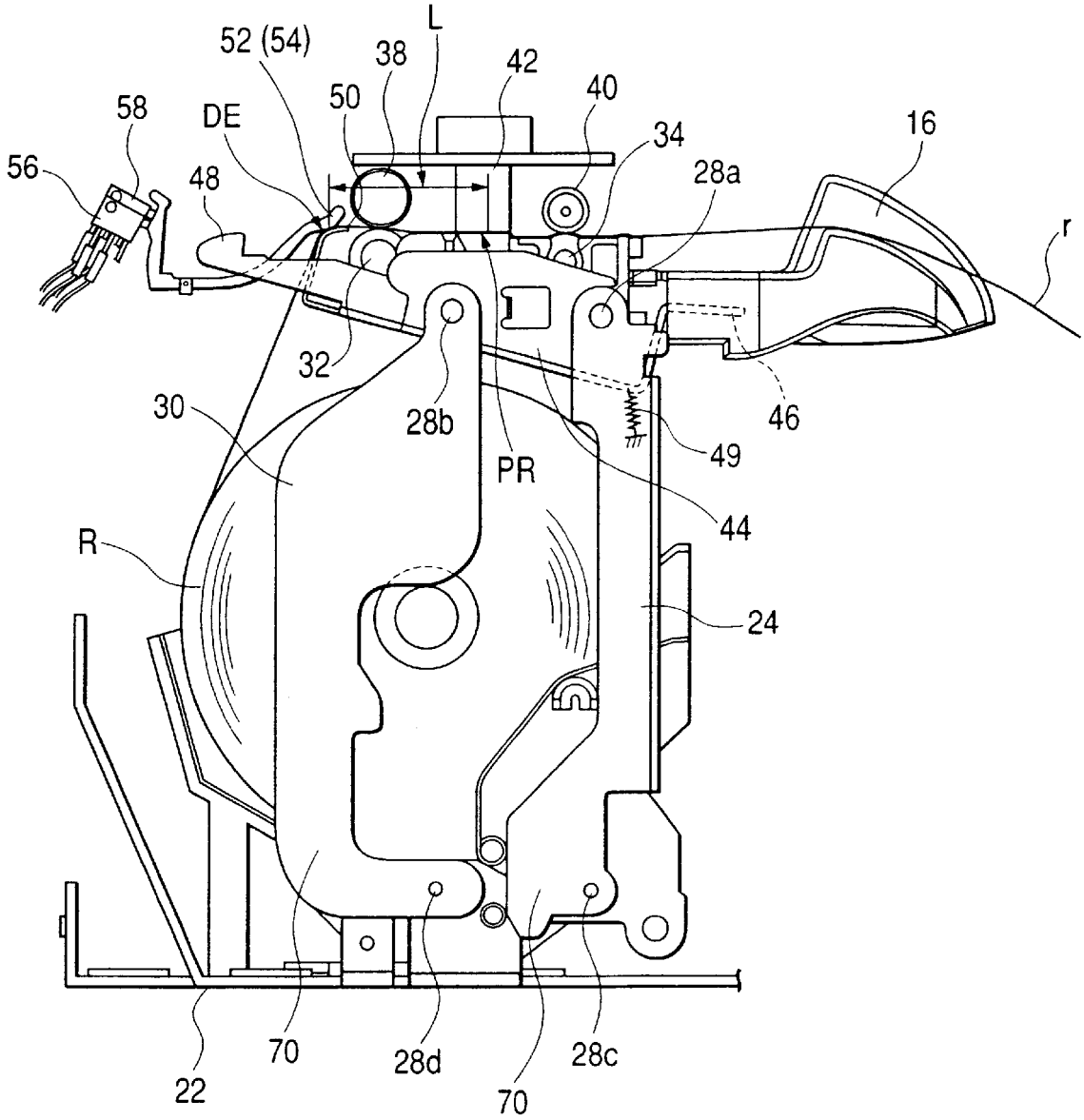
FIG. 5 is a side view of the internal structure while the door cover is closed.

FIGS. 3 and 4 are perspective views of an internal structure around the housing space in the printer 10, and respectively show the closed condition of the door cover 18 and the opened condition thereof. FIG. 5 is a side view of the internal structure when the door cover 18 is closed. As shown in these drawings, a frame member 22 on the side of the casing 12 is used to form the space 14 for housing the rolled paper R. Located in the housing space 14 is the holder 14*b* for supporting the rolled paper The door cover 18 is attached to a front side of the holder 14*b*.

The door cover 18 is formed by covering the outer surface of a frame member 24 with, for example, a plastic case member 26 (the case member 26 is omitted in FIG. 5). The lower end of the frame member 24 is pivotally supported by the frame member 22 on the casing, whereby the door cover 18 can be opened/closed in cooperation with operation of a four-joint link mechanism (described later) for movably supporting a transport roller unit 28.

The transport roller unit 28 is provided with a pinch roller 32, a driving roller 34 and a platen 36 on its transporting face. While the door cover 18 is closed with respect to the casing 12, the pinch roller 32 and the driving roller 34 respectively make contact with a driving roller 38 and a pinch roller 40, which are provided in the casing (see FIG. 5), to transport the rolled paper therebetween.

A paper feeding motor (not shown) is attached to the frame member 22 to transmit its driving force to the driving roller 38 via a casing-side transmission mechanism composed of gears (not shown) or the like. On the other hand. transmission gears 34*a* are provided in the transport roller unit 28. While the door cover 18 is closed, one of the gears forming the casing-side transmission mechanism engages with one of the transmission gears 34*a* to transmit the driving force of the paper feeding motor to the driving roller 34

While the door cover 18 is closed, the platen 36 is caused to face a print head 42, whereby characters can be printed on the paper (unrolled portion) drawn out from rolled paper R.

Other than the above ink-jet-type print head, a wire-dot-type print head may be adopted as the print head. In this case, the platen 36 is opposed to the print head 42 with a predetermined gap therebetween while the door cover 18 is closed. Further, a thermal-transfer-type print head may be also adopted In this case, a roller-shaped platen is used instead of the plate-shaped platen. The roller-shaped platen is brought into contact with the thermal-transfer-type print head while the door cover 18 is closed.

The transport roller unit 28 is provided with shafts 28*a* and 28*b*. The frame member 22 is provided with shafts 28*c* and 28*d*. An upper end portion of the frame member 24 is pivotably supported by the shaft 28*a*, and a lower end portion thereof is pivotably supported by the shaft 28*c*. On the other hand, an upper end portion of a coupling lever 30 is supported by the shaft 28*b*, and a lower end portion thereof is pivotably supported by the shaft 28*d*. Namely, the four-joint link mechanism is realized by the frame member 24, the coupling lever 30, the shafts 28*a*–28*d* provided on the transport roller unit 28, and the frame member 22. The transport roller unit 28 moves while keeping a substantially horizontal attitude when the door cover 18 is opened and closed, due to the parallel link mechanism.

A metal operation plate 44 is provided on the side of the door cover 18 such that the operation plate 44 and the door cover 18 overlap each other. A door operation lever 46, a pair of locking pawls 48 and a guide plate 50 are integrally formed on the operation plate 44. The operation plate 44 is pivotally supported by the shaft 28*b* of the coupling lever 30 and, while the door cover 18 is closed, the front ends of the locking pawls 48 are caused to mate with respective grooves 22*a* of the frame member 22. In order to keep the locking pawls 48 mating with the respective grooves 22*a* when the door cover 18 is closed, the operation plate 44 is always urged in a clockwise direction by an urging member such as a spring 49. When the door operation lever 46 is slightly lifted up against the urging force of the spring 49, the operation plate 44 turns in a counter-clockwise direction about the shaft 28*b* so as to let the locking pawls 48 come out of the grooves 22*a,* whereby the door cover 18 becomes openable. According to this embodiment of the invention, the door operation lever 46 is covered with the discharging section 16, and is incorporated therewith. Therefore, the operator is able to perform the aforementioned operations by lifting up the discharging section 16.

The guide plate 50, formed with the operation plate 44, is extended from below at the further upstream side of the pinch roller 32. The guide plate 50 is a member for guiding the paper end r, which is pulled out of the rolled paper R that is in the housing space 14, to the transporting face of the transport roller unit 28. As shown in FIG. 5, the paper end r is moved around the guide plate 50 so that the route of the paper end r is altered and then guided to the gap between the pinch roller 32 and the driving roller 38. The guide plate 50, together with the locking pawl 48, is lowered with respect to the transport roller unit 28 through the operation of the door operation lever 46 when the door cover 18 is opened so as to prevent the guide plate 50 from bumping against the driving roller 38. As shown in FIGS. 3 and 4, a cutout 50*a* is formed in the substantially central position in the width direction of the guide plate 50, which position corresponds to the front end position of one pivoting lever 54 that will be described below.

The printer 10 according to this embodiment is provided with a cover state detection mechanism CO for detecting whether the door cover 18 is opened or closed, and is also provided with a paper detection mechanism PE for detecting whether or not rolled paper still remains in the housing space 14. The construction of each mechanism will subsequently be described with reference to FIGS. 6 to 8, as enlarged views of an essential part of FIG. 5, as well as with reference to FIGS. 3 to 5.

Figure 6:
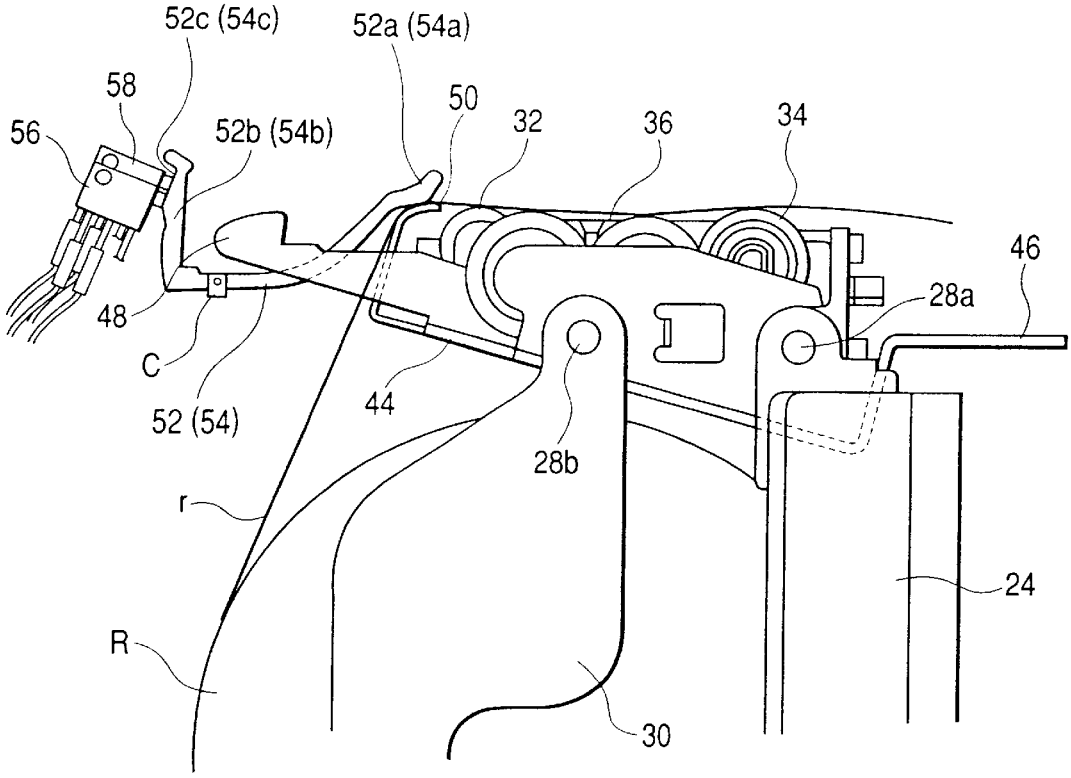
FIG. 6 is an enlarged view of an essential part of FIG. 5, and illustrates the closed condition of the door cover.

As shown in these drawings, the printer 10 is provided with two pivoting levers 52 and 54 and two micro-switches 56 and 58 arranged above and along the width direction of the housing space 14. The pivoting levers are similar in construction to one another, as are the micro-switches. The pivoting lever 52 and the micro-switch 56 on one side (the front side in the drawings) constitute the cover state detection mechanism, whereas the pivoting lever 54 and the micro-switch 58 on the other side (the rear side in the drawings) constitute the paper detection mechanism. Each of the pivoting levers 52 and 54 is made of elastic material such as, for example, plastics or the like. As clearly shown in FIG. 6, the pivoting levers 52 and 54 are pivotally supported by a detector attachment section 22*b*—(see FIGS. 3 and 4) of the frame member 22 of the casing 12—in an intermediate position C of the pivoting lever. Therefore, both a front end 52*a* (54*a*) and a rear end 52*b* (54*b*) of the lever 52 (54) are capable of pivoting. While the door cover 18 is closed, the front ends 52*a* and 54*a* of the pivoting levers 52 and 54 are made to face the guide plate 50. As shown in FIG. 6, while the paper end r is placed on the guide plate 50, the front ends 52*a* and 54*a* of the respective pivoting levers 52 and 54 make contact with the paper end r and are also lifted up by the pressing force of the guide plate 50. Incidentally, because the paper end r on the guide plate 50 is held down from above by force resistant to the force of the pivoting levers 52 and 54, the pivoting levers 52 and 54 serve as a paperweight for preventing the paper end r from floating-up.

The micro-switches 56 and 58 respectively are installed on the rear ends 52*b* and 54*b* of the pivoting levers, and are placed in such a condition that their buttons 56*a* and 58*a* have been held down by operating faces 52*c* and 54*c* of the respective pivoting levers 52 and 54. The printer 10 has a built-in control board (not shown). Detected-signal transmission lines are led out from each of the micro-switches 56 and 58, and are connected to the control board.

Figure 7:
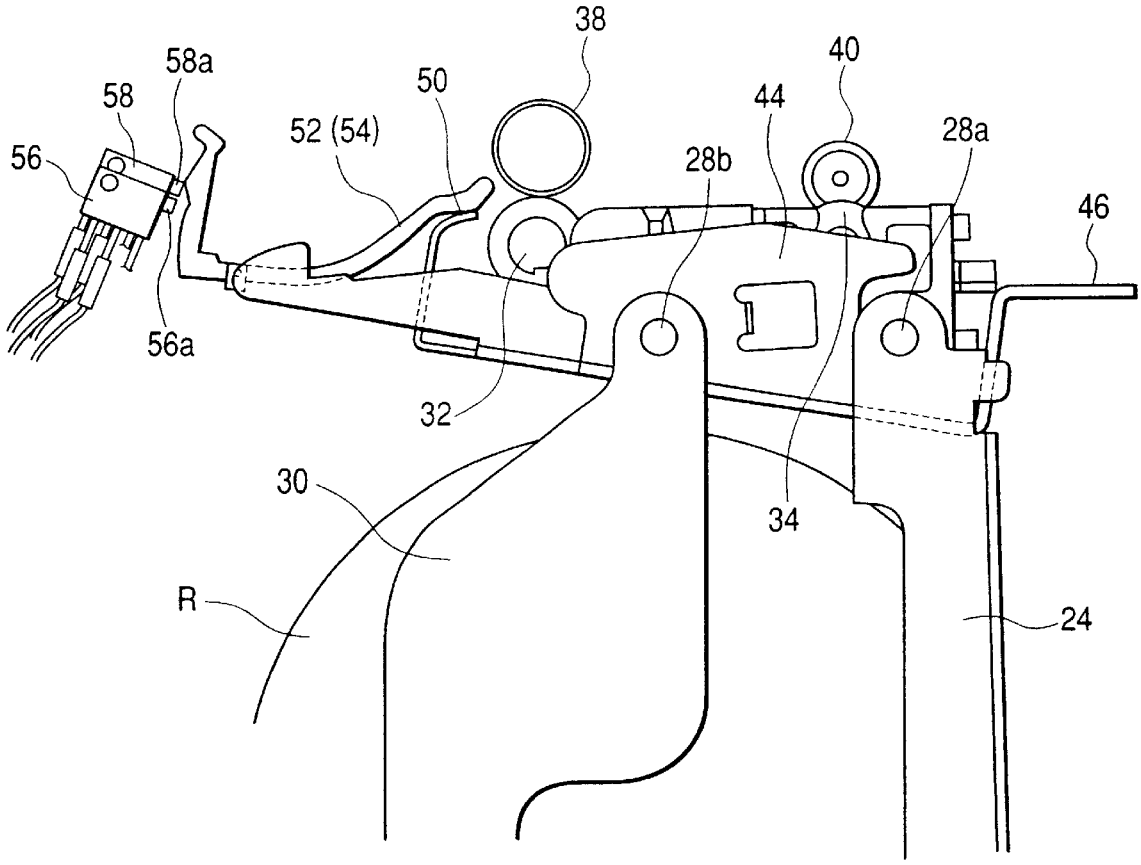
FIG. 7 is an enlarged view of an essential part of FIG. 5, and illustrates a condition In which a door operation lever has been operated.
Figure 8:
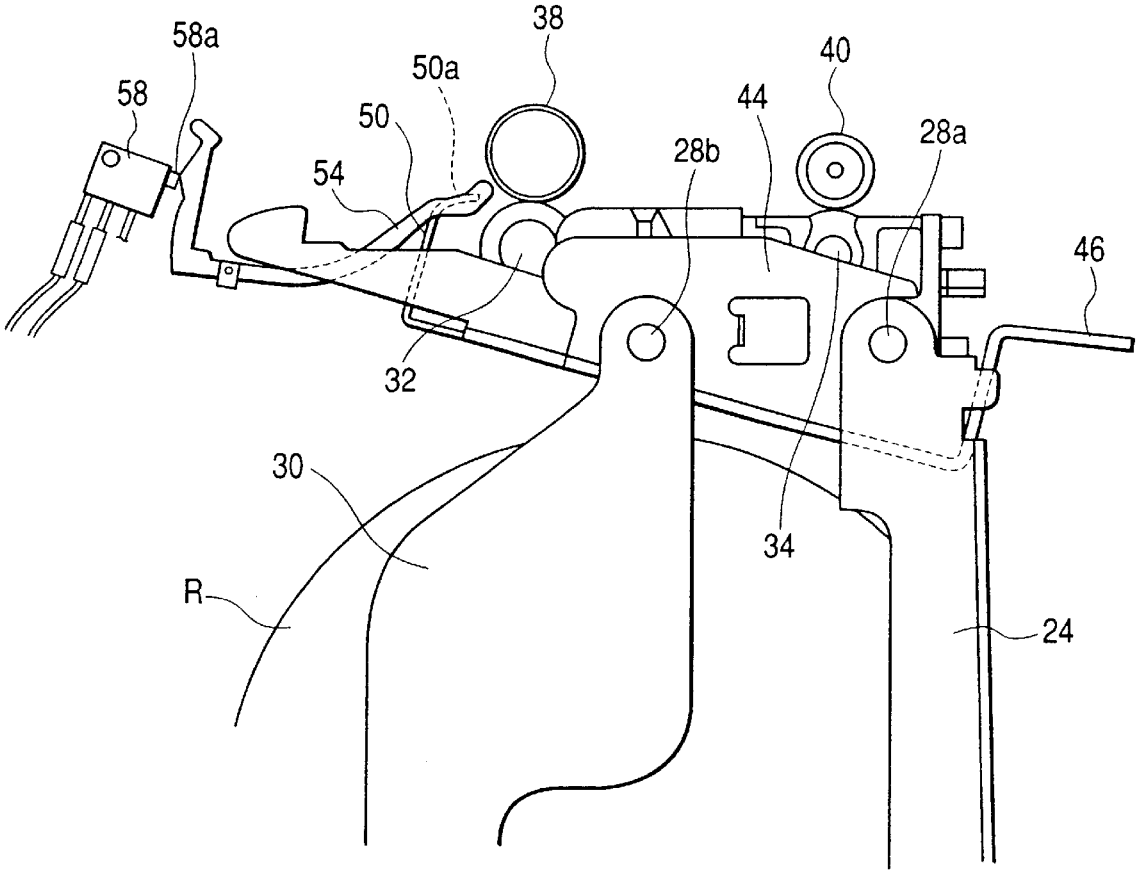
FIG. 8 is an enlarged view of a principal part of FIG. 5, and illustrates a condition in which the rolled paper has run out.

When the door operation lever 46 is lifted up, as shown in FIG. 7, in order to open the door cover 18 from the state shown in FIG. 6, the guide plate 50 is lowered as the operation plate 44 pivots, whereby the pivoting levers 52 and 54 pivot clockwise so that their operating faces 52*c* and 54*c* are released from the respective buttons 56*a* and 58*a* of the micro-switches 56 and 58. At this time, as shown in the drawings, the relative positions of the micro-switches 56 and 58 are slightly vertically shifted from each other. This vertically shifted positioning of the micro-switches 56 and 58 is a contrivance for making different the timing of releasing the operating faces 52*c* and 54*c* from the respective buttons 56*a* and 58*a* when the pivoting levers pivot. The micro-switch 56 which forms the cover state detection mechanism CO, is disposed under the micro-switch 58, which forms the paper detection mechanism PE. With this arrangement, the state of the micro-switch 56 (forming the cover state detection mechanism CO) is changed first when the door operation lever 46 is operated and the guide plate 50 is lowered, so that the detected signal therefrom is sent to the control board side. Then, the detected signal from the micro-switch 58 (forming the paper detection mechanism PE) is sent out. The state of the printer is decided thereafter by the control board on the basis of the detected signal initially received For this reason, a proper decision is made on the open or closed condition of the door cover 18 when the door operation lever 46 is operated as described above, so that the operator accurately can be informed of that condition.

As shown in FIGS. 3 and 4, on the other hand, the cutout 50*a* is formed in the guide plate 50 at a position corresponding to the front end position of the pivoting lever 54 forming the paper detection mechanism PE. Even while the door cover 18 is closed, the front end 54*a* of the pivoting lever 54 falls into the cutout 50*a* when the paper on the guide plate 50 has run out, which results in releasing the operating face 54*c* from the micro-switch 58 as the pivoting lever 54 pivots clockwise. The control board (not shown) receives the detected signal from the micro-switch 58, decides that the rolled paper has run out, and informs the operator to that effect.

As set forth above, two kinds of detection mechanisms—namely, the so cover state detection mechanism CO, and the paper detection mechanism PE—are disposed above the housing space 14 of the casing 12 in the printer 10 according to this embodiment of the invention. In this case, the positions of the micro-switches of the detection mechanisms are relatively shifted by the respective pivoting levers. Moreover, the output of the micro-switch 56 forming the cover state detection mechanism CO, always precedes the output of the micro-switch 58 when the door cover 18 is opened Therefore, the operator will never be informed by mistake that the rolled paper has run out when the door cover is opened.

Micro-switches are used to form each detection mechanism according to this embodiment of the invention. However, any other detection device, such as an optical sensor, may be used to detect the movement of the pivoting lever Moreover, the specific shape and installation mode of the pivoting lever may be other than those described heretofore. For example, the positions of the two micro-switches in the above embodiment of the invention may be set without shifting them vertically from each other. Instead, then, to shift the operations of the switches from each other, the shapes of the operating faces of the respective pivoting levers may be altered.

This embodiment of the invention is intended to solve the problem of mistakenly informing the operator that the rolled paper has run out when, in reality, the door cover is merely open. This embodiment solves the problem by, for example, shifting the installation positions of the detection mechanisms (the cover state detection mechanism CO and the paper detection mechanism PE) relative to one another. However, it is possible to solve the above-noted problem by subjecting the signal outputs from these detection mechanisms to predetermined processes without shifting the installation positions of the detection mechanisms relative to one another. A second embodiment of the invention will be described with reference to the drawings, wherein like reference characters designate like component parts as used in the first embodiment.

Figure 9:
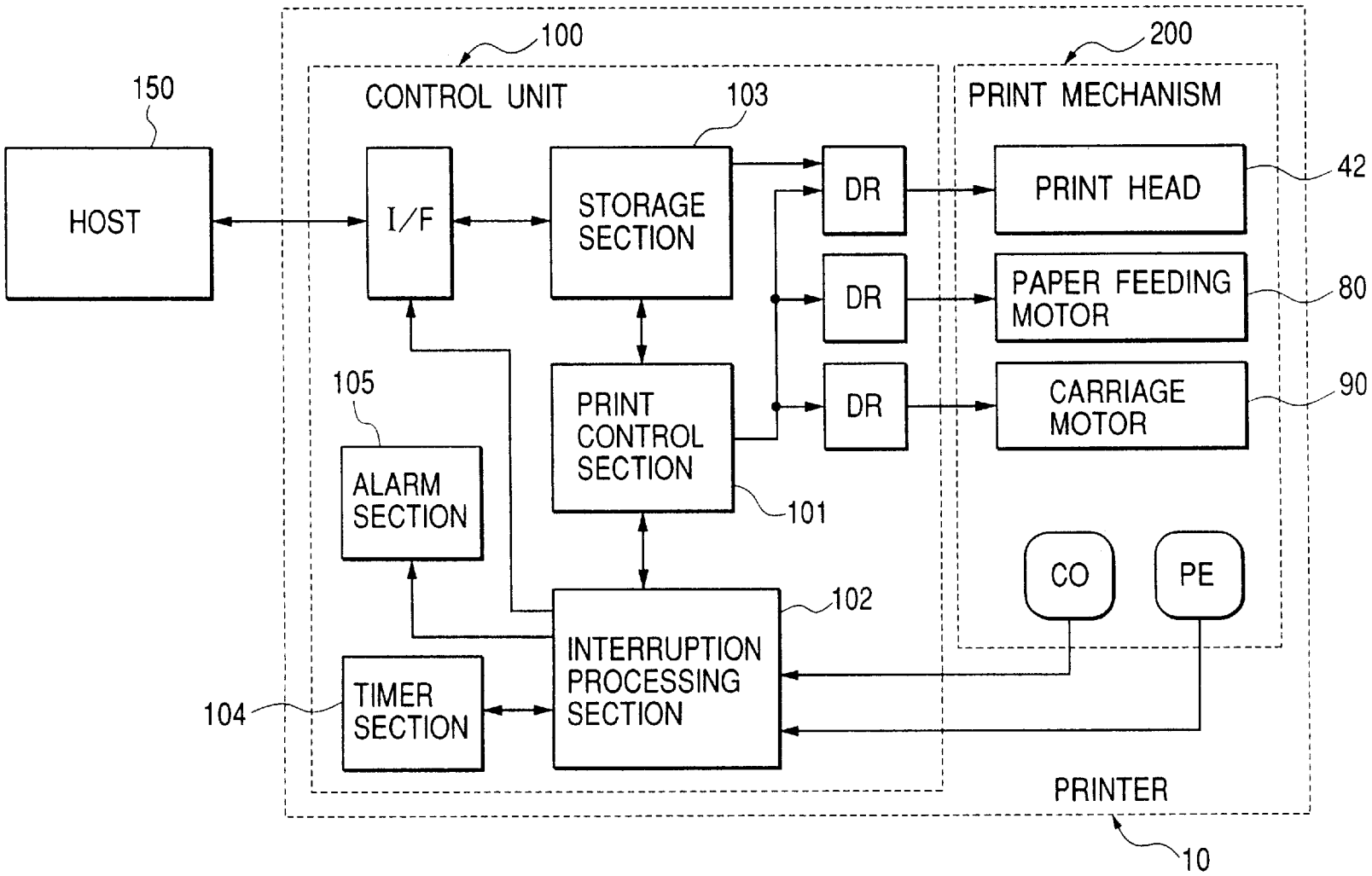
FIG. 9 is a block diagram showing an essential part of a printer according to a second embodiment of the invention.

FIG. 9 is a block diagram of an essential part of a printer according to the second embodiment. The printer 10 mainly comprises a print mechanism unit 200 and a control unit 100, whereby printing characters on paper is carried out in response to printing commands transmitted from a host 150. The print mechanism unit 200 includes a print head 42, a paper feeding motor 80, a carriage motor 90, a paper detection mechanism PE, and a cover state detection mechanism CO. The carriage motor 90 moves a carriage, which is loaded with the print head 42, relative to the paper. A mechanism is also provided for transferring the driving force of these motors 80 and 90 to rollers and carriages. The paper detection mechanism PE detects the presence or absence of paper. The cover state detection mechanism CO detects whether the cover is opened or closed. These mechanisms may be, for example, those described with reference to the printer shown in the first embodiment, or may be any known and generally adopted mechanisms. However, the installation positions of the paper detection mechanism PE and the cover state detection mechanism CO—which are different from those described in the first embodiment of the invention—are not shifted from each other so as to delay the transmission of the output of the paper detection mechanism PE when the door cover 18 is opened.

On the other hand, the control unit 100 comprises a communication interface I/F, a printing control section 101, a storage section 103, an interruption process section 102, a timer section 104, an alarm section 105, and various drivers DR. The communication interface I/F receives printing commands transmitted from the host 150. The printing control section 101 controls the print mechanism unit 200 in response to the printing commands. The storage section 103 (RAM) temporarily stores printing data transmitted with, mainly, the printing commands. The interruption process section 102 performs interruption process in response to signal outputs from the paper detection mechanism PE and the cover state detection mechanism CO. The timer section 104 counts a predetermined time period, whereas the alarm section 105 informs a user of printer conditions (paper end, door cover state, or the like). The various drivers DR drive the print head 42, the paper feeding motor 80, the carriage motor 90 and the like.

According to this embodiment of the invention, the printing control section 101 and the interruption process section 102 are previously stored as programs, in CPU and ROM, to be executed by the CPU. The alarm section 105 may be a display unit such as an LED, a liquid crystal display, or the like, or otherwise may be an acoustic unit such as a buzzer provided in the panel of the printer.

Figure 10:
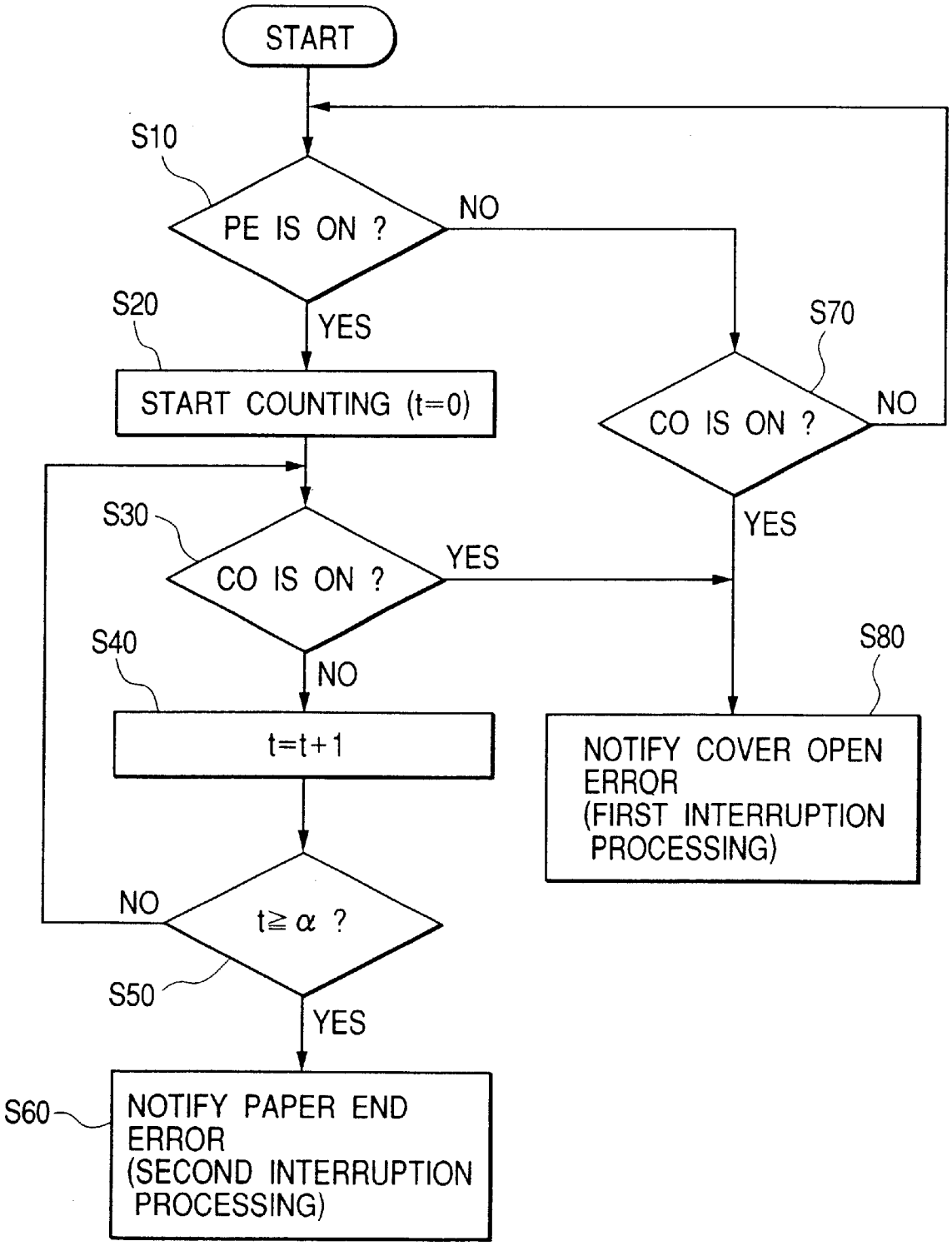
FIG. 10 is a flow chart showing an error process routine executed in the printer of FIG. 9.

The operation of the printer according to this embodiment will now be described with reference to FIG. 10, which is a flowchart showing interruption process executed by the interruption process section 102.

When no output is detected from both of the detection mechanisms (NO at Steps 10 and 70), the loop process between Steps 10 and 70 is repeated. When the output of the cover state detection mechanism CO is detected (YES at Step S70) before the output of the paper detection mechanism PE is detected, a first interruption process as described below is executed. In other words, the alarm section 105 informs the user that the cover is opened (cover open error, Step S80) and simultaneously transmits an interruption signal to the interruption process section 102. Upon receipt of the interruption signal, the interruption process section 102 processes the interruption signal in preference to the print process; in other words, it transmits a busy signal from the communication interface I/F to the host 150 and turns the line off Moreover, the interruption process section 102 also stops driving of the print head 42, the carriage motor 90 and the paper feeding motor 80 when the print process is being performed.

On the other hand, when the output of the paper detection mechanism PE is detected first (YES at Step 10), the timer section 104 starts counting (Step S20). When the output of the cover state detection mechanism CO is detected before the passage of a predetermined waiting time $\alpha$, the alarm section 105 notifies the user of a cover open error (the first interruption process, Step S80). In contrast, when the output of the cover state detection mechanism CO is not detected before the waiting time $\alpha$ elapses (YES at Step S50), a second interruption process is executed (Step 60). In other words, the alarm section 105 informs the user that the paper has run out (paper end error). At this time, the print process is stopped, and the relation between the host 150 and the communication interface I/F is set to "off-line" as in the first interruption process.

Instead of notifying the user of the errors (Steps S60 and S80) by using the alarm section 105 provided in the printer 10 itself, it may be acceptable to inform the user through use of the host 150 by transmitting the error status to the host 150 via the communication interface I/F.

Although the presence of the output of the cover state detection mechanism CO results in immediately executing the first interruption process (YES at Step 30 or 70), the presence of the output of the paper detection mechanism PE is never immediately connected to the execution of the second interruption process; instead, the second interruption process is executed after the passage of the waiting time period $\alpha$. Provided that the distance between the position DE, where paper is detected by the paper detection mechanism PE, and the printing position PR of the print head 42 is set to L (shown in FIG. 5), and provided that the paper transport speed is set to v, it is preferable to set the waiting time period $\alpha$ to a time period shorter than L/v. A nonconformity arises from performing the print process in such a state that the paper is absent in the printing position due to delaying the second interruption process more than necessary. Hence, it is possible to prevent such nonconformity by setting the waiting time $\alpha$ shorter than L/v.

In the second embodiment of the invention as set forth above, there has been shown an example in which the CPU executes the program of performing the interruption process by delaying the output of the paper detection mechanism PE by the predetermined time period after the detection of the output thereof. In other words, the CPU is provided with at least two interruption terminals, and the outputs of the cover state detection mechanism CO and paper detection mechanism PE are connected to the interruption terminals of the CPU.

Figure 11:
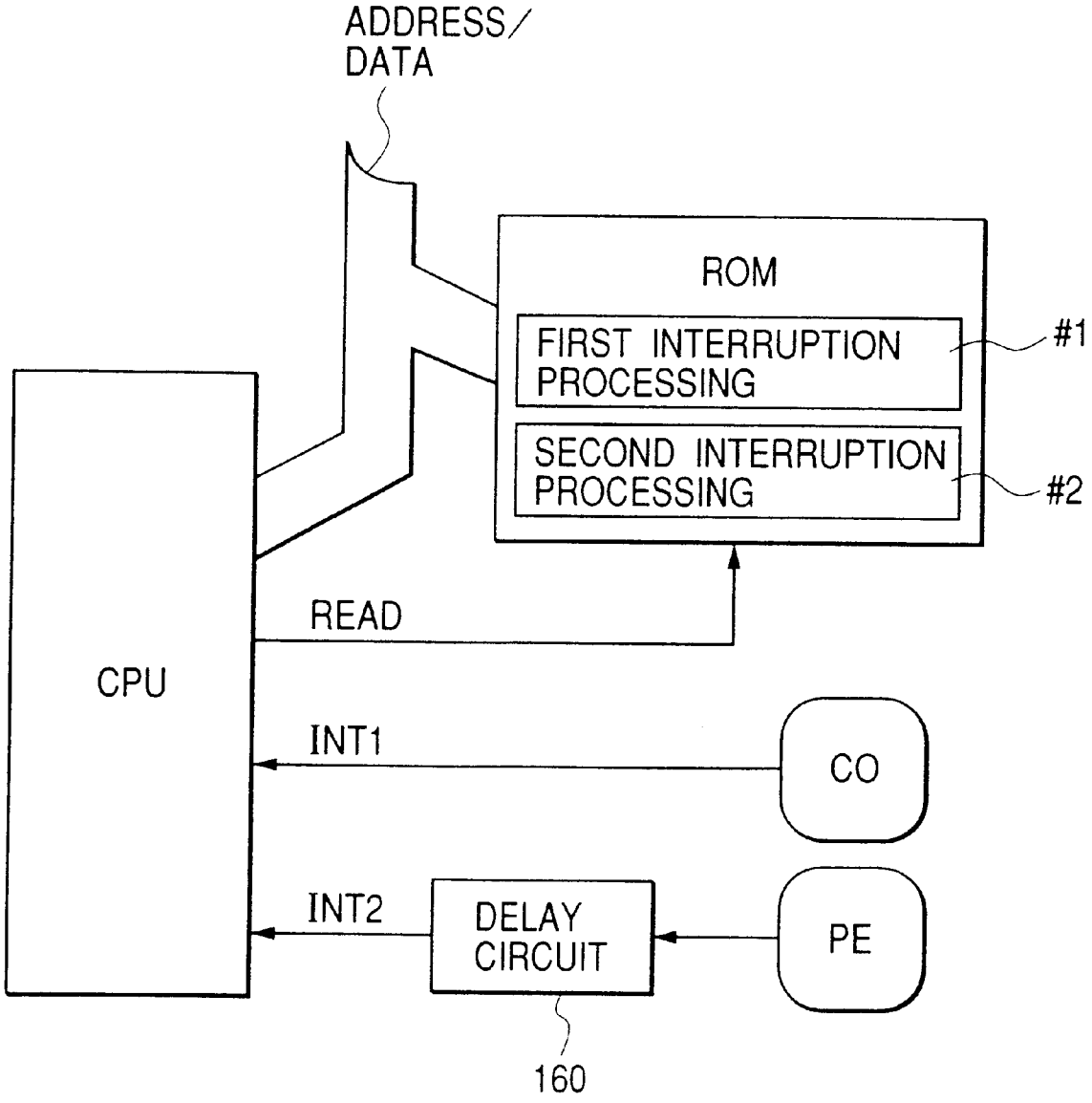
FIG. 11 is a block diagram showing a control section of a printer according to a third embodiment of the invention.

As shown in FIG. 11, according to a third embodiment of the invention, the output of the paper detection mechanism PE can be input to the CPU by simply using a delay circuit. The output of the cover state detection mechanism CO is directly connected to the interruption terminal INT1 of the CPU, whereas the output of the paper detection mechanism PE is connected to the interruption terminal INT2 of the CPU via a delay circuit 160 When any input is applied to the interruption terminal INT1, the first interruption process (notification of the cover open error, etc.) stored at or after a predetermined address (#1) in the ROM is executed. On the other hand, when any input is applied to the interruption terminal INT2, after being delayed by the delay circuit 160, the second interruption process (notification of the paper end error, etc.) stored at or after a predetermined address (#2) in the ROM is executed. Any known circuit may be employed as the delay circuit 160. However, it is necessary to set the delay time in such a delay circuit smaller than $\alpha$ as in the second embodiment of the invention.

Although various embodiments of the invention have been described with reference to the drawings, the invention is not limited to the matters indicated in the above embodiments thereof but may include a range of matters in which persons skilled in the art are allowed to modified and apply the invention on the basis of the scope of claims, the detailed description of the invention and the prior art.

For example, although a printer for printing characters on rolled paper has been shown as an exemplary embodiment of the invention, the invention is not limited thereto. Instead, the invention may be applied to any printer which has a casing for storing fan-folded paper, cut sheets and the like, a mechanism for detecting the presence or absence of these kinds of paper, and a mechanism for detecting the opened/closed state of that paper storing casing.

What is claimed is:

1. A printer comprising:

a holder, which accommodates paper therein;

a cover, which is movable between a first position for covering the paper accommodated in the holder and a second position for opening the holder such that an operator is able to access the accommodated paper;

a print mechanism, which transports the paper and prints information thereon;

a print controller, which controls the print mechanism to perform printing process;

a cover state detector, which outputs a first detection signal when the cover is moved from the first position to the second position;

a paper detector, which outputs a second detection signal when the paper has run out; and a delay generator, which delays the transmission of the second detection signal to the print controller relative to the first detection signal such that the print controller receives the first detection signal prior to the second detection signal.

2. The printer as set forth in claim 1, further comprising;

a frame that supports the holder, a print head disposed on one of the cover or the frame, and a platen disposed on the other one of the cover or the frame;

wherein the platen is opposed to the print head so as to perform printing on the paper guided therebetween, while the cover is placed in the first position.

3. A printer comprising:

a holder, which accommodates paper therein;

a cover, which is movable between a first position for covering the paper accommodated in the holder and a second position for opening the holder such that an operator is able to access the accommodated paper;

a print mechanism, which transports the paper and prints information thereon;

a print controller, which controls the print mechanism to perform printing process;

a cover state detector, which outputs a first detection signal when the cover is moved from the first position to the second position, the cover state detector including a first lever, which moves in cooperation with the movement of the cover, and a first detector that detects the movement of the first lever;

a paper detector, which outputs a second detection signal when the paper has run out, the paper detector including a second lever, which moves in cooperation with the movement of the cover and moves when the paper accommodated in the holder runs out, and a second detector that detects the movement of the second lever; and a support member, which supports the cover state detector and the paper detector in a configuration wherein the movement of the first lever is detected by the first detector prior to when the movement of the second lever is detected by the second detector.

4. The printer as set forth in claim 3, further comprising:

a frame that supports the holder, a print head disposed on one of the cover or the frame, and;

a platen disposed on the other one of the cover or the frame, wherein the platen is opposed to the print head so as to perform printing on the paper guided therebetween, while the cover is placed in the first position.

5. The printer as set forth in claim 3, wherein the first and second levers are arranged to pivot around an axis that is perpendicular to a direction in which the paper is transported.

6. The printer as set forth in claim 3, further comprising:

a guide plate, which guides the paper toward the print mechanism; and an urging member that urges each of the first and second levers toward the guide plate.

7. The printer as set forth in claim 6, wherein:

the guide plate is formed with a cutout portion into which the second lever enters when the paper accommodated in the holder runs out; and the second detector detects the movement of the second lever when the second lever enters the cutout portion.

8. The printer as set forth in claim 3, wherein:

the first and second levers are pivotably supported by the support member;

the first detector includes a first button switch onto which the first lever abuts; and the second detector includes a second button switch onto which the second lever abuts.

9. The printer as set forth in claim 3, further comprising a notifier, which notifies that the cover is opened, when the movement of the first lever is detected by the first detector, and which notifies that the paper accommodated in the holder has run out, when the movement of the second lever is detected by the second detector.

10. A printer comprising:

a holder, which accommodates paper therein;

a cover, which is movable between a first position for covering the paper accommodated in the holder and a second position for opening the holder such that an operator is able to access the accommodated paper;

a print mechanism, which transports the paper and prints information thereon;

a print controller, which controls the print mechanism to perform printing;

a cover state detector, which outputs a first detection signal when the cover is moved from the first position to the second position;

a paper detector, which outputs a second detection signal when the paper has run out; and a delay circuit that delays the transmission of the second detection signal to the print controller relative to the first detection signal such that the print controller receives the first detection signal prior to the second detection signal.

11. The printer as set forth in claim 10, further comprising:

a frame that supports the holder, a print head disposed on one of the cover or the frame, and;

a platen disposed on the other one of the cover or the frame, wherein the platen is opposed to the print head so as to perform printing on the paper guided therebetween, while the cover is placed in the first position.

12. A printer comprising:

a holder, which accommodates paper therein;

a cover, which is movable between a first position for covering the paper accommodated in the holder and a second position for opening the holder such that an operator is able to access the accommodated paper;

a print mechanism, which transports the paper and prints information thereon;

a cover state detector, which outputs a first detection signal when the cover is moved from the first position to the second position;

a paper detector, which outputs a second detection signal when the paper has run out; and a controller for controlling the print mechanism to perform printing process, wherein the controller is configured to execute a first interruption process in preference to the printing process, when receiving the first detection signal within a predetermined time period, and to execute a second interruption process that is different from the first interruption process, when receiving no first detection signal within the predetermined time period.

13. The printer as set forth in claim 12, further comprising a timer, which counts the predetermined time period, wherein the controller executes the first interruption process, when receiving the first detection signal prior to the second detection signal; and wherein the timer starts to count the predetermined time period, when receiving the second detection signal prior to the first detection signal.

14. The printer as set forth in claim 12, wherein the controller halts or forbids printing process, during each of the first and second interruption processes.

15. The printer as set forth in claim 12, further comprising a notifier, which notifies that the cover is opened, when the first interruption process is executed.

16. The printer as set forth in claim 12, further comprising a notifier, which notifies that the paper accommodated in the holder has run out, when the second interruption process is executed.

17. An error process method, used for the printer provided with a holder, which accommodates paper therein; a cover, which is movable between a first position for covering the paper accommodated in the holder and a second position for opening the holder such that an operator is able to access the accommodated paper; a print mechanism, which transports the paper and prints information thereon; a cover state detector, which outputs a first detection signal when the cover is moved from the first position to the second position and; a paper detector, which outputs a second detection signal when the paper has run out; the error process method comprising the steps of:

counting a predetermined time period, when receiving the second detection signal;

executing a first interruption process prior to a printing process, when receiving the first detection signal within the predetermined time period; and executing a second interruption process, which is different from the first interruption process, when receiving no first detection signal within the predetermined time period.

18. The error process method as set forth in claim 17, wherein:

the first interruption process is executed when receiving the first detection signal prior to the second detection signal; and the counting step is established when receiving the second detection signal prior to the first detection signal.

19. The error process method as set forth in claim 17, wherein each of the first and second interruption processes includes a step of halting or forbidding the printing.

20. The error process method as set forth in claim 17, wherein the first interruption process includes at least one of the steps of:

notifying a cover open error to a host connected to the printer; and notifying a cover open error to the operator through a notifier provided with the printer.

21. The error process method as set forth in claim 17, wherein the second interruption process includes at least one of the steps of:

notifying a paper end error to a host connected to the printer; and notifying a paper end error to the operator through a notifier provided with the printer.

22. The error process method as set forth in claim 17, wherein the predetermined time period is so determined as to be smaller than a value L/v, where L is a distance between a printing position of the print mechanism and a detecting position of the paper detector, and v is a transporting velocity of the paper.

* * * * *